US008925348B2

(12) United States Patent
Gagne

(10) Patent No.: US 8,925,348 B2
(45) Date of Patent: Jan. 6, 2015

(54) SURVIVAL BRACELET

(71) Applicant: Kevin Gagne, Bedford, NH (US)

(72) Inventor: Kevin Gagne, Bedford, NH (US)

( * ) Notice: Subject to any disclaimer, the term of this patent is extended or adjusted under 35 U.S.C. 154(b) by 9 days.

(21) Appl. No.: 13/772,083

(22) Filed: Feb. 20, 2013

(65) Prior Publication Data

US 2013/0213089 A1 Aug. 22, 2013

Related U.S. Application Data

(60) Provisional application No. 61/601,613, filed on Feb. 22, 2012.

(51) Int. Cl.
*A44C 5/00* (2006.01)

(52) U.S. Cl.
CPC ..... *A44C 5/0007* (2013.01)
USPC ..... 63/1.12; 63/3.1

(58) Field of Classification Search
USPC ..... 63/3, 3.1, 1.12, 4
See application file for complete search history.

(56) References Cited

U.S. PATENT DOCUMENTS

| | | | | |
|---|---|---|---|---|
| 4,177,522 | A | 12/1979 | Auburn | |
| 7,447,118 | B1 | 11/2008 | Matos | |
| 8,171,639 | B2 | 5/2012 | Jaykins | |
| 2010/0050690 | A1 | 3/2010 | Woodward | |
| 2012/0159987 | A1 | 6/2012 | Walchle et al. | |
| 2013/0031935 | A1 * | 2/2013 | Kelleghan | 63/1.12 |

* cited by examiner

*Primary Examiner* — Victor Batson
*Assistant Examiner* — Abigail Morrell
(74) *Attorney, Agent, or Firm* — Lambert & Associates; Gary E. Lambert; David J. Connaughton, Jr.

(57) ABSTRACT

A survival bracelet comprised of a woven strap, a spark source, a scraper, and tinder is provided. The strap may be unwoven for survival use. The spark source, scraper, and tinder are integrated into the bracelet.

20 Claims, 3 Drawing Sheets

SURVIVAL BRACELET

CROSS REFERENCE TO RELATED APPLICATIONS

This application is a non-provisional application which claims the benefit to Provisional Application No. 61/601,613 filed Feb. 22, 2012.

BACKGROUND OF THE INVENTION

1. Field of the Invention

The present invention relates generally to stitched bracelets. More particularly the present invention relates to a survival bracelet.

2. Description of Related Art

Currently, it is known to weave high-strength, durable cord, such as paracord, into bracelets, necklaces and other articles. The paracord is weaved such that an individual wearing the item can unweave the paracord in a relatively easy manner and utilize the paracord in an emergency situation. Wearing the paracord as a bracelet, necklace, belt, or other item provides access to the cord wherever it is worn in the event an emergency situation arises.

A predetermined length of paracord is used and selected based on the intended wearer's sizing, and weaved to a length appropriate for the particular piece of article to be worn. Because the paracord is typically high-strength, military grade paracord, the cord is not designed to stretch any significant amount. The additional strength added by weaving the paracord increases resistance to stretching. As such, the length of the paracord and the size of the article produced from the paracord must be perfectly sized to fit the individual wearing it. Moreover, any increase or decrease in the size of the individual cannot be accommodated by the item, requiring a new paracord article to be purchased at a different size.

Typically, the ends of the paracord are joined by a common stainless steel shackle, adjustable shackle or plastic slide release buckle. The shackle includes a U-shaped portion and steel pin for enclosing the ends of the paracord within the shackle. The shackle has two holes for inserting a locking pin. Generally, only one shackle hole is threaded and engages the threaded portion of the pin when the pin is fully inserted. The opposing hole is non-threaded, fixedly securing the pin in the shackle. Thus, the paracord length and shackle must be sized an appropriate length to accommodate the wearer's dimensions.

Further, these paracord bracelets are limited in their use to uses of the unwoven cord, and do not include a number of important survival elements. As such, they leave much to be desired as a survival tool.

Therefore, what is needed is a survival bracelet that has a number of survival necessities integrated into it.

SUMMARY OF THE INVENTION

The subject matter of this application may involve, in some cases, interrelated products, alternative solutions to a particular problem, and/or a plurality of different uses of a single system or article.

In one aspect, a survival bracelet is provided. The survival bracelet is formed from an elongate strap woven to form a body of the bracelet. The strap forms a loop at a first end of the bracelet, and has a free end at the second, opposite end. A quantity of tinder is formed into a twine and stitched into the weave of the bracelet. A scraper plate is further attached to the bracelet. Further, a firesteel toggle is attached to the free end of the bracelet. The toggle has an aperture through its width, through which the free end of the bracelet passes, and is secured thereto.

In another aspect, a method of using the survival bracelet is provided. The method includes releasing the survival bracelet from a wrist of the user, removing a tinder from the bracelet, and removing a scraper plate from the bracelet. The tinder may be fluffed into a fibrous form. The scraper plate may be scraped against a firesteel toggle or other spark source, causing sparks. These sparks may be directed at the tinder, igniting the tinder. Further, a strap forming the bracelet may be unwound and used for any number of uses.

DETAILED DESCRIPTION

Figure 1:
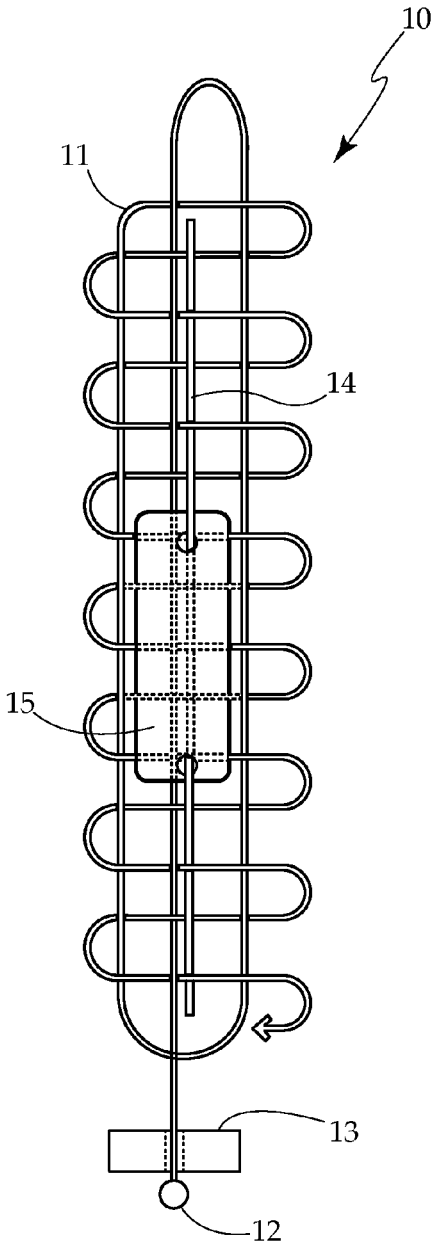
FIG. 1 provides a diagram view of an embodiment of the survival bracelet components.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a survival bracelet that comprises a woven strap, scraper plate, fire-starter or sparking source, and tinder, all integrated into the bracelet. The bracelet is intended to be worn by a user at all times such that it is readily available in the event that other survival gear is lost, damaged, forgotten, or otherwise unavailable.

The woven strap forms a body of the bracelet, and is stitched to maximize a length of the strap. The strap may be of any flexible elongate material. In one embodiment, the strap is made of paracord, as defined in Mil-C-5040 Type III, incorporated herein by reference. The strap forms a body of the bracelet when woven, but may be easily unwound to achieve its full length. Once unwound, the cord may be used for climbing, creating a shelter, setting a trap, first aid, and the like. In addition, the bracelet may be used in a woven or partially woven form for survival uses, such as using the weave as a rock sling pocket for hunting or defense.

The strap may be woven in any way that allows it to form a bracelet when wound and allows for a substantial length of cord when unwound. This weaving may allow for easy and quick unraveling in an emergency situation. Examples of weaves that may be used include the River Bar, Cobra Stitch, Solomon Bar, Ladder Rack, and the like. In one embodiment, a custom stitch may be used to maximize cord length per inch of woven bracelet. The custom stitch can be seen in FIG. 1, and is formed as follows:

Anchoring one end of the strap either on a jig, or another anchoring object, the working end of the cord is stretched taught at the length of the final bracelet, then turned around to form a bight. In an embodiment where a jig is used, a peg may be positioned to aid in formation of the bight. The working end is then brought down to approximately ½" from the start anchor point, brought laterally across the original strap, around, forming another bight, and back to the top of the bracelet, approximately ¾" from the first bight. In embodiments using the jig, there may be pins around which the strap may be wrapped to aid in directional change and hold the strap in place as needed. Once to approximately the top of the bracelet, the strap may be turned another 90 degrees (again a pin may aid in this when using a jig) so as to approach perpendicular to the longitudinal cords.

This results in a "loom" of three parallel cords, running nearly the length of the bracelet, approximately ½" apart for a total width of approximately 1". The working end is then woven over-under-over until the entire length of the bracelet (less the loop and secured end) is filled. The working end is then tucked. In one embodiment, this tucking may be performed utilizing a paracord fid (lacing needle) and snipped clean and flush.

Different lengths of strap may be used depending on weave type, strap material, and wrist size. In one embodiment, ten to fifteen feet of strap may be woven to create the bracelet.

In a particular embodiment, the woven strap may comprise a loop on a proximal end, and a single strand free end of the strap on a distal end. This embodiment may allow for a "toggle and loop" system to secure the bracelet about a user's wrist. The toggle and loop system comprises a bar that may be passed through the loop in one orientation, and be oriented perpendicularly to the loop, preventing its passage in a second orientation. It should be understood, however, that any closure or clasp may be used to secure the bracelet, in varying embodiments.

A scraper plate may be attached to the bracelet when the strap is in a woven form. In some embodiments, the scraper plate may be configured to remain attached to the strap when the bracelet is unwound.

The scraper plate may be configured to be used to create sparks from a spark source. The scraper plate may be made out of any material capable of creating a spark from a spark source. Examples of materials of which the scraper plate may be made include, but are not limited to: metals such as stainless steel, steel, tin, etc., composite materials, a stone such as flint, and the like.

The scraper plate may be sized and shaped such that it may be handled by a user when scraping against the spark source, but preferably is small enough to fit on the bracelet without extending beyond the surface of the bracelet. In one embodiment, the scraper plate may have a rounded rectangular shape. However, it should be understood that the scraper plate may be any size and shape capable of being scraped against a spark source.

In one embodiment, the scraper plate may have information engraved on one or both surfaces. Examples of engraved information may include identification information, emergency medical information, and the like.

In another embodiment, the scraper plate may further have a polished or reflective surface. This embodiment allows the scraper plate to be additionally used for sun signaling.

In yet another embodiment, the scraper plate may further have a sharpened edge, allowing the scraper plate to be additionally used for cutting, scraping, and the like.

In still another embodiment, the scraper plate may be useable as a fishing lure. In this embodiment, the scraper plate may be curved to move through the water to attract attention of a fish. In a further embodiment, a hook may be integrated into the scraper plate, or attachable to the scraper plate.

A quantity of sparking material may be attached to the bracelet. The sparking material may be any composition that provides sparks when struck or scraped. In one embodiment, the sparking material may be ferrous metal. In another embodiment, the sparking material may be Firesteel or similar ferrocerium material.

In one embodiment, the firesteel material is comprised of approximately 50% Cerium, 25% lanthanum, trace amounts of neodymium, and praseodymium, with the balance being iron and magnesium.

In another embodiment, the firesteel material is comprised of approximately 19% Iron, 38% Cerium, 22% Lanthanum, 4% Neodymium, 4% Praseodymium, and 4% Magnesium.

The sparking material may be integrated into the bracelet in any manner. In one embodiment, the sparking material may be formed in a bar or cylinder shape, having a hole formed along a diameter. In a further embodiment, the cylindrical sparking material may be used as the toggle for the "toggle and loop" attachment for the bracelet, as discussed above. In this embodiment, the strap may be passed through the hole of the cylinder, and secured by a knot or other structure. In this embodiment, the cylindrical sparking material may or may not be removed from the strap when in use.

It is noted that the integration of the firesteel or other sparking material is of particular value to the present invention. While a number of survival products exist, they all lack this integrated sparking material. Moreover, because of the importance of fire in survival situations, it provides a vital element to a survival bracelet. Despite this importance, the prior art has failed to develop an integrated solution as described herein.

A quantity of tinder may be attached to the strap when in a woven, bracelet form. In some embodiments the tinder may remain attached to the strap when unwoven. The tinder may be formed of any flammable, fibrous material. Examples of materials of which the tinder may be made include, but are not limited to jute, kenaf, hemp, flax, ramie, and the like.

In some embodiments, the tinder may be attached to the bracelet body by being stitched into the weave. In these embodiments, the tinder may be a fibrous material such as a twine, capable of being stitched or threaded into the bracelet.

In one embodiment, the tinder may be used to attach the scraper plate to the bracelet. In this embodiment, the tinder may be formed into a roughly twine type form, hooked or looped through the scraper plate, and stitched into the bracelet strap. In these embodiments, the twine may be removable from the bracelet, and may benefit from being drawn or fluffed apart to make the tinder more open and flammable. It should be understood that the tinder may be removable, and reinstalled without unraveling the bracelet in many embodiments.

In a particular embodiment, a darning needle may be used to stitch the twine into the woven bracelet strap.

In a further embodiment, an instruction manual in the form of a booklet, video, audio, or website, may be provided to teach users how to properly stitch and use the bracelet. In one embodiment, the bracelet may be delivered in a woven form having the custom weaving noted above. However, in survival situations and practice situations, the bracelet should be unwoven. To put the strap back together in bracelet form as originally provided, the instruction manual may teach the custom weaving noted. Further the instruction manual may provide instruction on use of the various elements of the survival bracelet such as twine, sparking source, scraper plate, and the like.

Turning now to FIG. 1 a view showing a stitch pattern of the bracelet is provided. The strap 11 is woven about itself forming the bracelet 10 as shown in the figure. A ball 12 is formed into a distal end of the strap 11. The ball may be a plastic ball attached to the strap, a knot, a melted or burned end of the strap 11, or other diameter widening structure. A firesteel toggle 13 is positioned by the distal end of the strap 11, and prevented from slipping off the strap 11 by the ball 12. A quantity of tinder 14 is formed into a twine and stitched through strap 11 along the length of the bracelet 10. This tinder 14 may be easily removed from the bracelet 10 by being drawn through the stitches of the bracelet 10. A scraper plate 15 is held to the bracelet 10 by the tinder 14.

Figure 2:
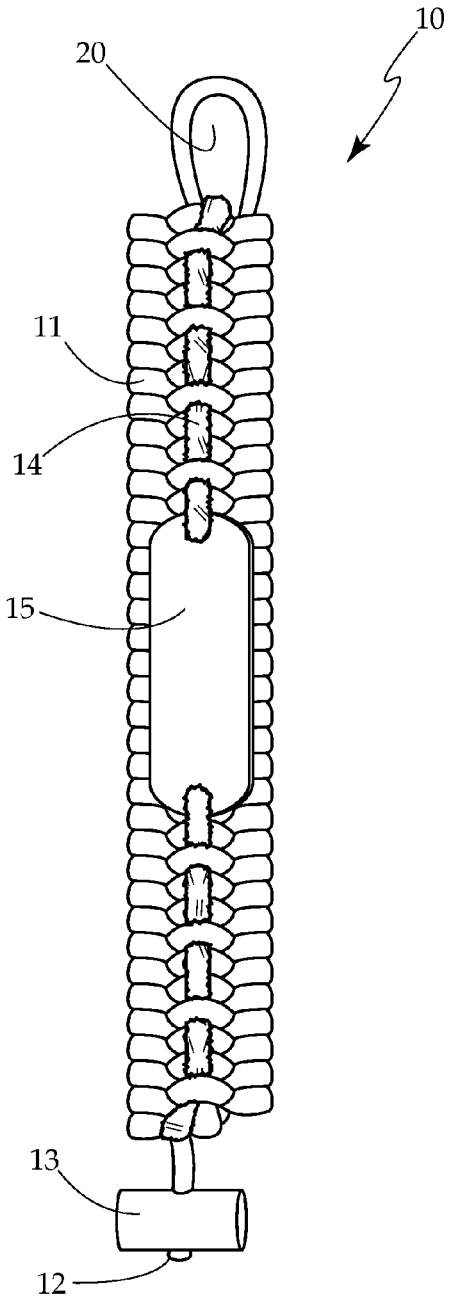
FIG. 2 provides an aerial view of an embodiment of the survival bracelet.

FIG. 2 shows another embodiment of the bracelet. In this view, the bracelet 10 is shown tightly woven in an operational mode. In this embodiment, a loop 20 is formed by the strap 11. The loop 20 may be used with the firesteel toggle 13 to secure the bracelet 10 about the wrist of a user. In this embodiment, the firesteel toggle 13 may be passed through the loop 20 and then oriented perpendicularly to the loop 20 such that it cannot easily pass through. The toggle 13 is further held in place by ball 12. The scraper plate 15 is shown attached to the bracelet by the tinder 14 formed as a twine that is stitched through the woven bracelet. In an alternative embodiment, the scraper plate 15 may be attached directly to the strap 11 by a portion of cable passing through the apertures on each side.

Figure 3:
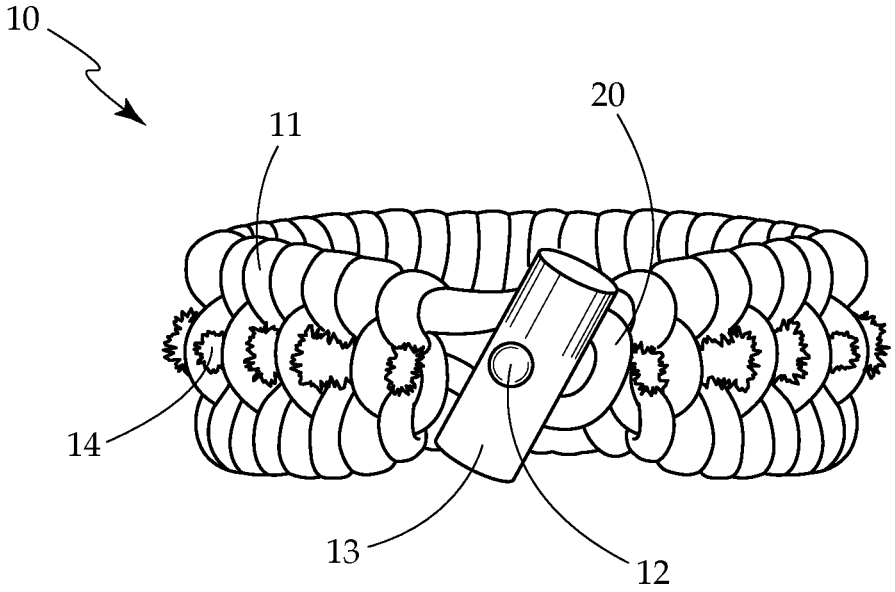
FIG. 3 provides a perspective view of an embodiment of the bracelet.
Figure 4:
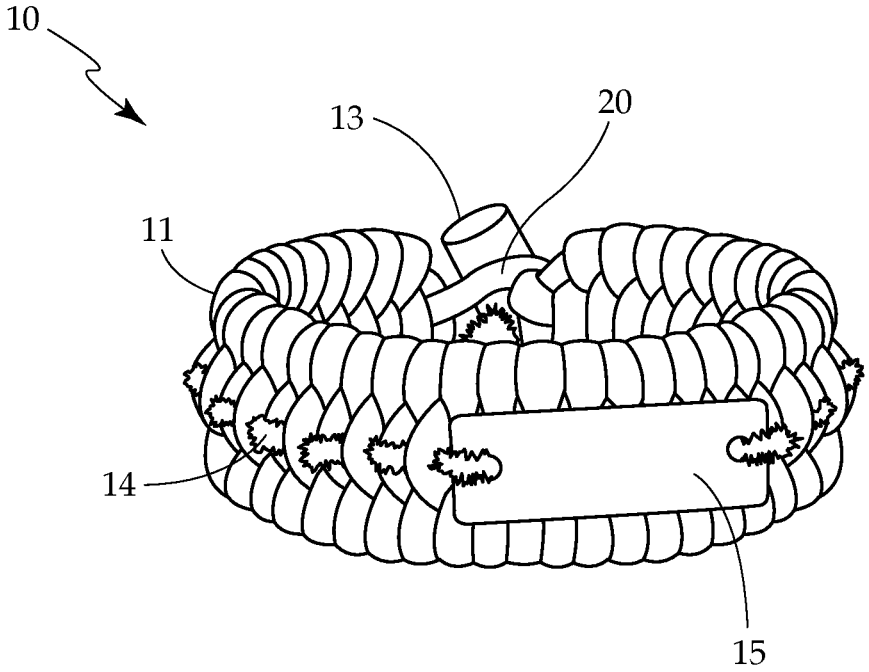
FIG. 4 provides a perspective view of an embodiment of the bracelet.

FIGS. 3 and 4 provide front and back perspective views of the bracelet in a closed position. In these views, the bracelet 10 is held closed by the firesteel toggle 13 being passed through the loop 20. The strap 11 is tightly woven to provide the body of the bracelet 10. The tinder 14 is stitched through the center of the bracelet 10 and through the top crossing portions of the strap 11. The tinder 14 is further used to secure the scraper plate 15 to the bracelet.

Figure 5:
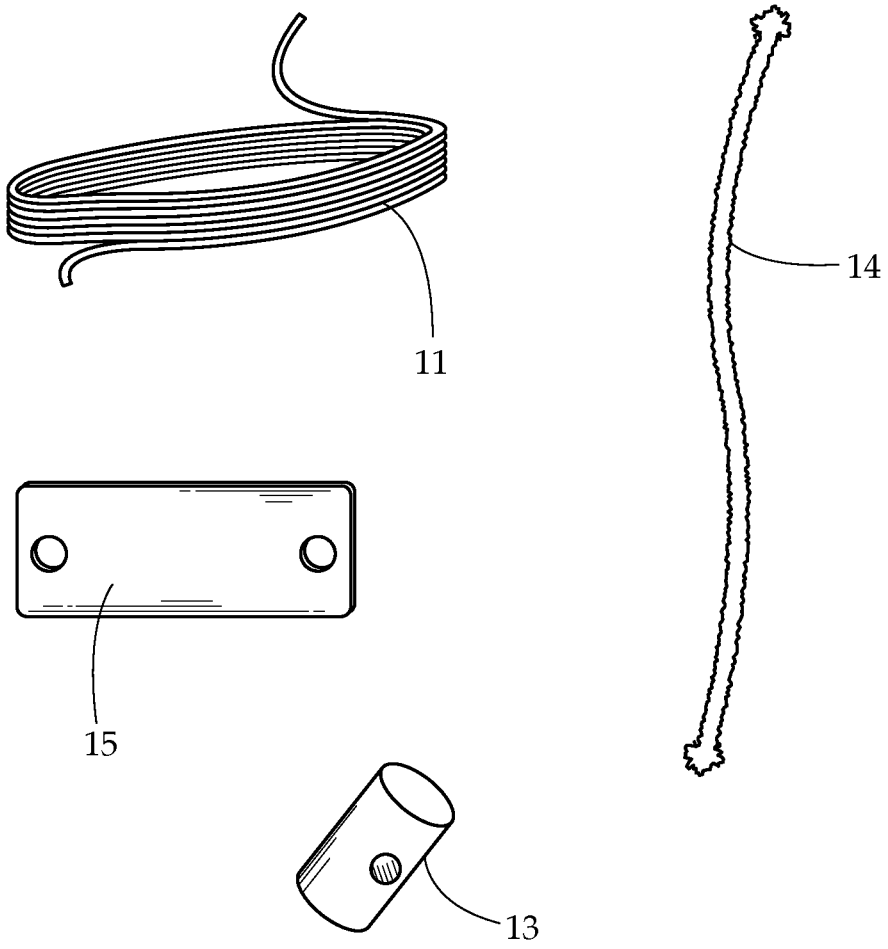
FIG. 5 provides a deconstructed view of the bracelet elements.

FIG. 5 provides a deconstructed view of an embodiment of the bracelet elements. The strap 11 is shown in an unwoven condition. The tinder 14 is partially in a twine form, with an end portion fluffed up to make it more effective tinder. The firesteel toggle 13 is removed from the strap 11, and the scraper plate 15 has been removed from the strap.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A survival bracelet comprising:

an elongate strap, the strap being woven to form a body of the bracelet, the strap forming a loop at a first end of the bracelet, and a free strand at a second end;

a quantity of tinder, the tinder formed into a twine and stitched into the weave of the bracelet;

a scraper plate attached to the bracelet;

a firesteel toggle, the firesteel toggle being formed as a bar and forming an aperture through its width, the firesteel toggle being secured to the bracelet by the free strand of the strap passing through the aperture, the firesteel toggle being sized to pass only widthwise through the loop.

2. The survival bracelet of claim 1 wherein the firesteel toggle is a sparking source.

3. The survival bracelet of claim 1 wherein the scraper plate further comprises a quantity of identification information disposed on a top surface.

4. The survival bracelet of claim 1 wherein the scraper plate further comprises a reflective top surface.

5. The survival bracelet of claim 1 wherein the scraper plate further comprises a sharpened edge.

6. The survival bracelet of claim 1 wherein the free strand of the strap further comprises a knot to prevent the strap from passing through the aperture of the firesteel toggle.

7. The survival bracelet of claim 1 wherein the scraper plate is curved along its length, and further comprises a hook, such that the scraper is formed as a fishing lure.

8. The survival bracelet of claim 1 wherein the scraper plate further forms two apertures at opposite sides, the tinder passing through each of the apertures and attaching the scraper plate to the bracelet.

9. The survival bracelet of claim 1 wherein the tinder is formed of fibrous jute material.

10. The survival bracelet of claim 1 wherein the weave of the strap comprises two lengthwise loops of the strap, the two lengthwise loops forming three lengthwise strands of the strap approximately equal to the length of the bracelet, a first bight end protruding from two of the lengthwise strands forming the loop at the first end, a remainder of the strap being woven perpendicularly between the three lengthwise strands, thereby forming the bracelet.

11. The survival bracelet of claim 1 further comprising a jig, the jig comprising a pin and a guide to re-weave the strap into the bracelet once un-woven.

12. The survival bracelet of claim 1 further comprising an instruction manual.

13. A method of using a survival bracelet comprising:

releasing the survival bracelet from a wrist of a user, the survival bracelet comprising:

an elongate strap, the strap being woven to form a body of the bracelet, the strap forming a loop at a first end of the bracelet, and a free strand at a second end;

a quantity of tinder, the tinder formed into a twine and stitched into the weave of the bracelet;

a scraper plate attached to the bracelet;

a firesteel toggle, the firesteel toggle being formed as a bar and forming an aperture through its width, the firesteel toggle being secured to the bracelet by the free strand of the strap passing through the aperture, the firesteel toggle being sized to pass widthwise through the loop;

removing the tinder from the bracelet;

removing the scraper plate from the bracelet;

fluffing the tinder from the bracelet;

scraping the scraper plate against the firesteel toggle, causing sparks;

directing the sparks at the tinder, igniting the tinder.

14. The method of claim 13 further comprising the step of unweaving the strap to disassemble the bracelet.

15. The method of claim 13 further comprising the step of using a sharpened edge of the scraper plate for cutting.

16. The method of claim 13 further comprising signaling with the scraper plate by reflecting the sun with a reflective surface of the scraper plate.

17. The method of claim 13 further comprising the step of using the scraper plate as a fishing lure, the scraper plate being shaped to wiggle through water, and comprising a fish hook.

18. A method of using a survival bracelet comprising:

releasing the survival bracelet from a wrist of a user, the survival bracelet comprising:

an elongate strap, the strap being woven to form a body of the bracelet, the strap forming a loop at a first end of the bracelet, and a free strand at a second end;

a quantity of tinder, the tinder formed into a twine and stitched into the weave of the bracelet;

a scraper plate attached to the bracelet;

a firesteel toggle, the firesteel toggle being formed as a bar and forming an aperture through its width, the firesteel toggle being secured to the bracelet by the free strand of the strap passing through the aperture, the firesteel toggle being sized to pass widthwise through the loop;

unweaving the strap to disassemble the bracelet, the tinder and scraper plate being removed during the unweaving.

19. The method of claim 18 further comprising the step of using a sharpened edge of the scraper plate for cutting.

20. The method of claim 18 further comprising the step reflecting the sun with a reflective surface of the scraper plate.

* * * * *